US006679156B1

(12) United States Patent
Danou

(10) Patent No.: US 6,679,156 B1
(45) Date of Patent: Jan. 20, 2004

(54) WEAPON WITH ROTATING BARREL

(76) Inventor: Samir A. Danou, 5403 Telegraph, Bloomfield Township, MI (US) 48302

( * ) Notice: Subject to any disclaimer, the term of this patent is extended or adjusted under 35 U.S.C. 154(b) by 0 days.

(21) Appl. No.: 10/101,359

(22) Filed: Mar. 18, 2002

(51) Int. Cl.[7] ..... F41A 13/10; F41A 13/12
(52) U.S. Cl. ..... 89/14.1; 89/162; 89/191.01
(58) Field of Search ..... 89/14.1, 162, 191.01

(56) References Cited

U.S. PATENT DOCUMENTS

| | | | | | |
|---|---|---|---|---|---|
| 2,547,180 | A | * | 4/1951 | Taylor | 42/16 |
| 3,738,044 | A | * | 6/1973 | Robinson | 89/160 |
| 4,259,891 | A | | 4/1981 | Rosenzweig | 89/12 |
| 4,285,152 | A | * | 8/1981 | Dean | 42/59 |
| 4,462,061 | A | | 7/1984 | Mommsen | 361/227 |
| 4,535,676 | A | | 8/1985 | Politzer et al. | 89/14.1 |
| 4,700,608 | A | | 10/1987 | Pettinga et al. | 89/11 |
| 4,884,490 | A | | 12/1989 | Hurlemann | 89/14.1 |
| 5,050,480 | A | * | 9/1991 | Knight, Jr. et al. | 89/147 |
| 5,202,530 | A | | 4/1993 | Stephens | 89/7 |
| 5,974,941 | A | * | 11/1999 | Kushnir et al. | 89/155 |
| 5,983,774 | A | | 11/1999 | Mihaita | 89/187.02 |

FOREIGN PATENT DOCUMENTS

| | | | | |
|---|---|---|---|---|
| DE | 34 30 521 A1 | * | 2/1986 | 89/14.1 |
| IT | 431245 | * | 2/1948 | 89/14.1 |

* cited by examiner

*Primary Examiner*—Stephen M. Johnson
(74) *Attorney, Agent, or Firm*—Rader, Fishman & Grauer, PLLC

(57) ABSTRACT

A weapon for firing a projectile is provided that includes a receiver within which is disposed a loading mechanism for loading and unloading the weapon. A feed system supplies the loading mechanism with ammunition and a firing mechanism releases the loading mechanism for loading and firing the projectile. A barrel is rotatively secured to the receiver and preferably includes a rifled bore that imparts a gyroscopic spin on the projectile and a rotational force on the barrel causing the barrel to rotate as the projectile is fired. In a preferred embodiment, the barrel is provided with a plurality of blades that capture air and generate airflow across the weapon and barrel to cool the barrel.

24 Claims, 8 Drawing Sheets

WEAPON WITH ROTATING BARREL

BACKGROUND OF THE INVENTION

1. Field of the Invention

The present invention generally relates to a weapon that includes a means of cooling the weapon barrel while firing the weapon. More particularly, the invention relates to a weapon having a unitary barrel equipped with fan-like blades rotatably mounted to a receiver of the weapon. Upon firing of the weapon, the barrel rotates causing the blades to generate an air flow across the barrel to cool the barrel and the weapon to substantially prevent overheating.

2. Description of the Related Art

Weapons are commonly used in combat situations that place great pressures on the integrity of the weapon. Intense and rapid firing is one common pressure placed on a weapon during combat that results in the eventual malfunction of or damage to the weapon. To the combatant, reliability of the weapon is of principal importance. Continuous operation of a weapon in combat without breakdown from intense firing is a necessity for the combatant who relies on the weapon for survival and defense.

It is a well-known problem that rapid firing of projectiles, such as bullets, from the barrel of a weapon causes the barrel to heat-up and in time overheat. An overheated barrel distorts the path of the projectile exiting the weapon, which adversely effects the accuracy of the weapon. Further, overheating of the weapon barrel can distort the barrel, resulting in jamming or misfiring of the weapon. Prolonged overheating of the barrel also causes plastic deformation of the barrel, which effects the flight path of the projectile even after the barrel properly cooled.

Systems that cool weapon barrels are well known in the art. Attempts to prevent overheating of a weapon barrel have focused on cooling the weapon barrel through the use of cooling fluids. In such applications, fluid-carrying tubes are provided around the exterior of the barrel or are embedded into the barrel itself. A pump, carried on the weapon or in a pack carried separately by the combatant, circulates the cooling fluid in a constant fluid stream or in a measured dose of fluid following each projectile round.

Although effective in cooling the barrel, fluid cooling systems are generally impractical. The additional hardware, i.e., the pumps, valves, and coolant canister, make the weapon bulky and difficult to use in combat situations. Some fluid cooling systems require the weapon to be connected by tubular lines to a separate package the carries the coolant system or fluid. These lines interfere with the weapon's operation and can be easily damaged in the combat environment.

Another known countermeasure to prevent the overheating of a weapon barrel requires the replacement of the weapon barrel. Once a barrel overheats, the operator discards the overheated barrel and installs a new barrel to commence firing. However, this replacement option exhibits several limitations. First, replaceable-barrel weapons require the combatant to carry replacement barrels and tools to conduct the replacement. These items add weight to an already overburden gear pack of the battlefield combatant. Second, barrel replacement requires time to complete. In a combat event, time is generally not available to quickly and correctly install a new barrel on the weapon. Also, foreign objects, such as dirt, sand, snow or water, may enter the weapon during installation of a replacement barrel, adversely effecting operation of the weapon thereafter.

Another common solution to preventing overheating of the barrel is to provide the weapon with multiple, sequentially utilized barrels. Multi-barrel weapons are well known in the art and generally include a plurality of barrels arranged about a central shaft. During operation, the shaft rotates to align a barrel with a cartridge for the automatic receiving and firing of the cartridge. Upon firing, the central shaft rotates to align the next barrel for firing. Unfortunately, multi-barrel weapons possess several limitations. One limitation is that the weapon requires many heavy parts, including the weight of the multiple barrels, which makes transport and handling of the weapon by the combatant difficult. Another limitation is that multiple barrels add cost and complexity to the manufacture of the weapon.

SUMMARY OF THE INVENTION

The present invention overcomes the limitations of prior art weapon systems by providing a unitary barrel weapon having a means for effectively cooling the barrel and the weapon without requiring removal of the barrel or the use of a fluid cooling system. In accordance with a preferred embodiment of the present invention, a weapon for firing a projectile is provided that includes a receiver within which is disposed a loading mechanism for loading and unloading the weapon. A feed system is connected to the receiver for supplying the loading mechanism with ammunition. A firing mechanism releases the loading mechanism for loading, firing the projectile, and unloading the spent casing once the projectile is fired.

A barrel is rotatively secured to the receiver and is rotatively supported at a distance removed from the receiver by a barrel mount. In a preferred embodiment, the barrel is provided with a plurality of blades that capture air and generate airflow across the rotating barrel to cool the barrel. The barrel is also preferably provided with a rifled bore that imparts a gyroscopic spin on the projectile and a rotational force on the barrel causing the barrel to spin as the projectile is fired.

Among other advantages, the weapon of the present invention is provided with a means of cooling the barrel and the weapon to virtually eliminate the need to change the barrel or cease firing of the weapon for relatively long periods to allow the barrel to cool. Another advantage is that rotation of the barrel can be achieved mechanically, electromechanically or merely as a result of a projectile(s) travelling through the bore of the barrel. Still another advantage is that the unitary weapon barrel rotates about its own axis, unlike the prior art, thereby reducing the overall weight of the weapon.

Various additional aspects and advantages of this invention will become apparent to those skilled in the art from the following detailed description of the preferred embodiment, when read in light of the accompanying drawings.

BRIEF DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

Figure 1:
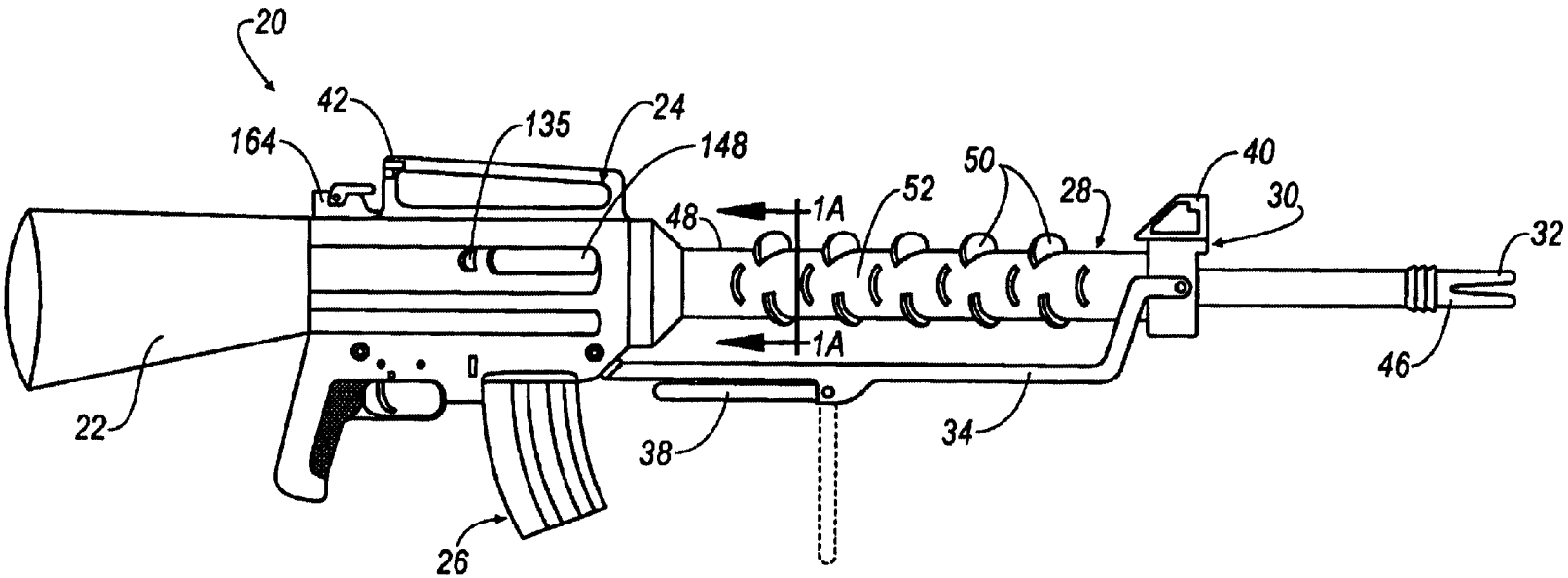
FIG. 1 is a plan view of a weapon according to a preferred embodiment of the present invention.

Referring now to the drawings, the preferred embodiments of the present invention are shown in detail. The figures depicted in the drawing are not to scale and the elements of the present invention are not necessarily shown in the figures as being in relative proportion to one another. Accordingly, the following figures are offered only as a generally representation of the present invention to aid in describing the preferred embodiments thereof.

FIG. 1 is a plan view of an open-bolt weapon 20 that is capable of automatic or single shot fire control of bullet-like projectiles. Weapon 20 generally includes a stock or butt 22 mated to the rear of a receiver 24. An ammunition feed system 26 preferably extends from the underside of receiver 24 and feeds a cartridge 25 (FIGS. 2 and 5) into receiver 24 during operation of weapon 20. As is known in the art, cartridge 25 is a unit of ammunition comprising a projectile 27, such as a bullet, a casing that holds a propellant charge and primer cap for igniting the propellant. In a preferred embodiment, ammunition feed system 26 is a detachable magazine or clip that feeds cartridges 25 into weapon 20 by spring action or other mechanism known in the art. Alternatively, receiver 24 may be fitted with a belt-feed type ammunition feed system, which would receive cartridges 25 into the side of receiver 24 and enable weapon 20 to fire cartridges from either a detachable magazine or an ammunition belt.

A barrel 28 extends from receiver 24, through a barrel mount 30, to an exiting end 32 of barrel 28. A rigid support bar 34, which is generally parallel to barrel 28, extends from receiver 24 and is attached to barrel mount 30 to support both barrel mount 30 and barrel 28. Support bar 34 is preferably removably attached to both receiver 24 and barrel mount 30 to enable barrel mount 30 to be removed and barrel 28 to be replaced if necessary. A handle 38 may be pivotally affixed to support bar 34 to enable a user of weapon 20 to effectively balance and support weapon 20 without contacting barrel 28. Optionally, a vented cover (not illustrated) may extend over barrel 28 to prevent the user from inadvertently contacting barrel 28. An adjustable front sight 40 mounts atop barrel mount 30 and cooperates with a rear sight 42 on receiver 24, as is known in the art.

Figure 1A:
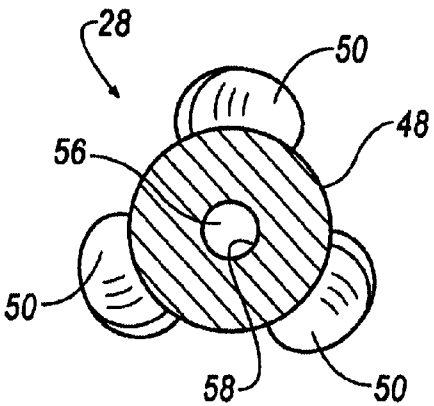
FIG. 1A is a cross-sectional view of a barrel taken along the lines 1A—1A in FIG. 1.

Barrel 28 is preferably an elongated tubular member made from steel or other strong, rigid material suitable for firing bullet-type projectiles. A muzzle 46 is attached to exiting end 32 of barrel 28 and provides a point of exit from which projectile 27 is propelled from weapon 20. Barrel 28 is provided with an external peripheral surface 48 that preferably supports a plurality of blades 50. Blades 50 extend radially outward from barrel 28 about its circumference. As illustrated in FIG. 1A, each blade 50 is preferably a thin, generally petal-shaped plate with substantially smooth, rounded edges. Blades 50 are preferably made of a heat transferring material such as steel, although any rigid and durable material could be used. Each blade 50 is provided with a slight twist to capture air and generate airflow across surface 48. Blades 50 are arranged substantially uniformly about the circumference of barrel 28 with gaps 52 provided between each blade 50.

Preferably, as illustrated in FIG. 1A, a group of circumferentially adjacent blades 50 cooperate to form a fan structure to maximize the airflow generating potential of blades 50 and to provide balance along barrel 28 necessary to ensure the accuracy of projectile 27 when fired from weapon 20. A series of fan structures preferably repeat along barrel 28 between receiver 24 and barrel mount 30 in an alternating pattern, as illustrated in FIG. 1. However, it will be appreciated that any number of blades 50 may be provided on barrel 28 in any suitable configuration that generates an airflow across barrel 28 and weapon 20. Moreover, blades 50 may take any suitable shape that is capable of capturing air and generating airflow across barrel 28 and weapon 20.

Although blades 50 are preferably attached to barrel 28 by welding or affixing each individual blade 50 to barrel 28 using a one or more fasteners, the present invention is not intended to be limited thereto. Alternatively, as shown in the example illustrated in FIGS. 10 and 11, blades 50 may be affixed to a ring member 53 having an internally threaded surface. External peripheral surface 48 of barrel 28 may be provided with a plurality of externally threaded areas 54 that are spaced apart axially along a portion of barrel 28. A plurality of ring members 53 may then be threaded onto barrel 28 to form a series of fan structures. Each ring member 53 may be provided with a set screw 55 to prevent rotation of ring members 53 once they are threaded onto barrel 28.

Figure 5:
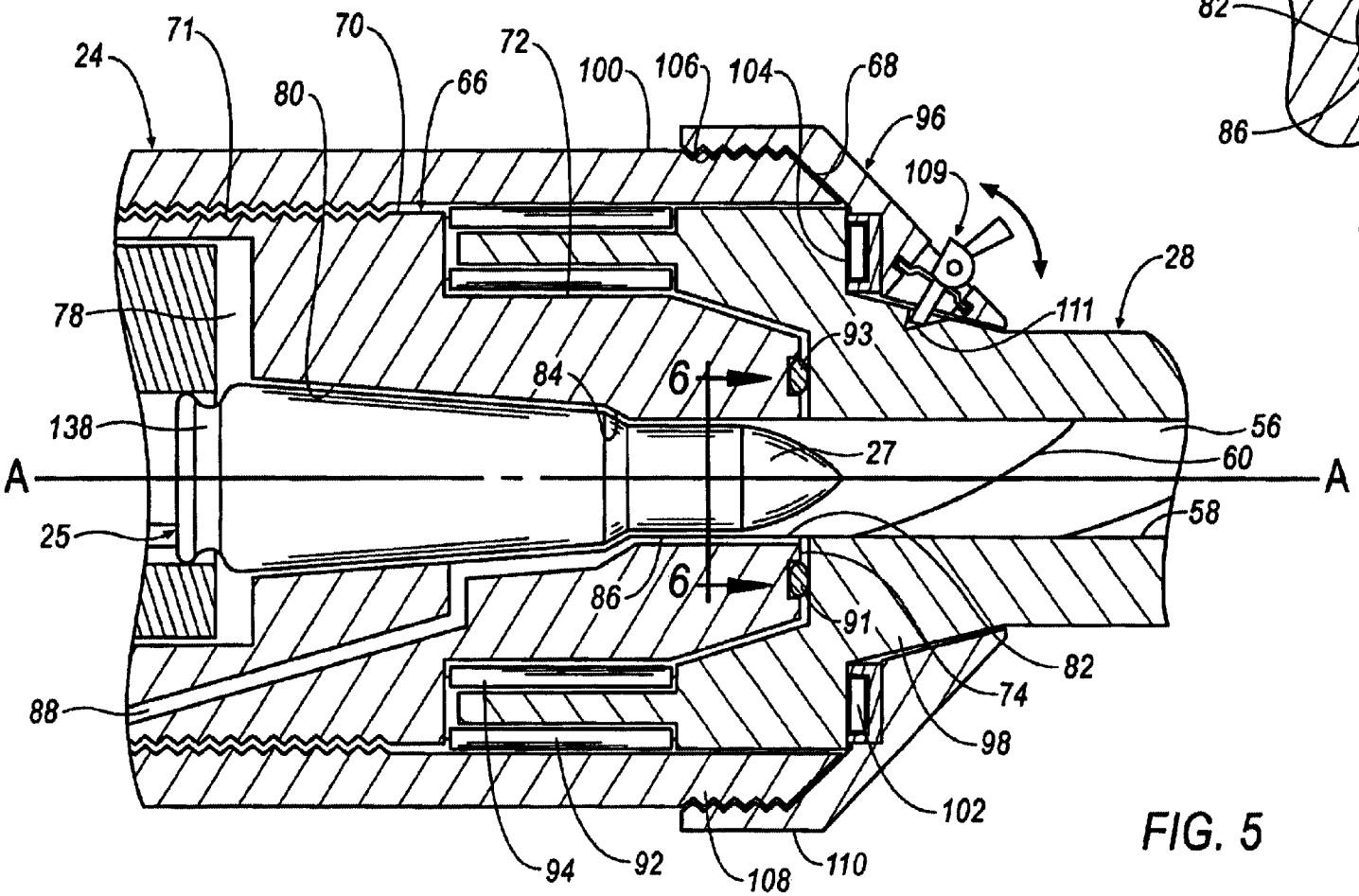
FIG. 5 is a cross-sectional view of the weapon of FIG. 1 showing the interface between the cartridge housing and the barrel.
Figure 7:
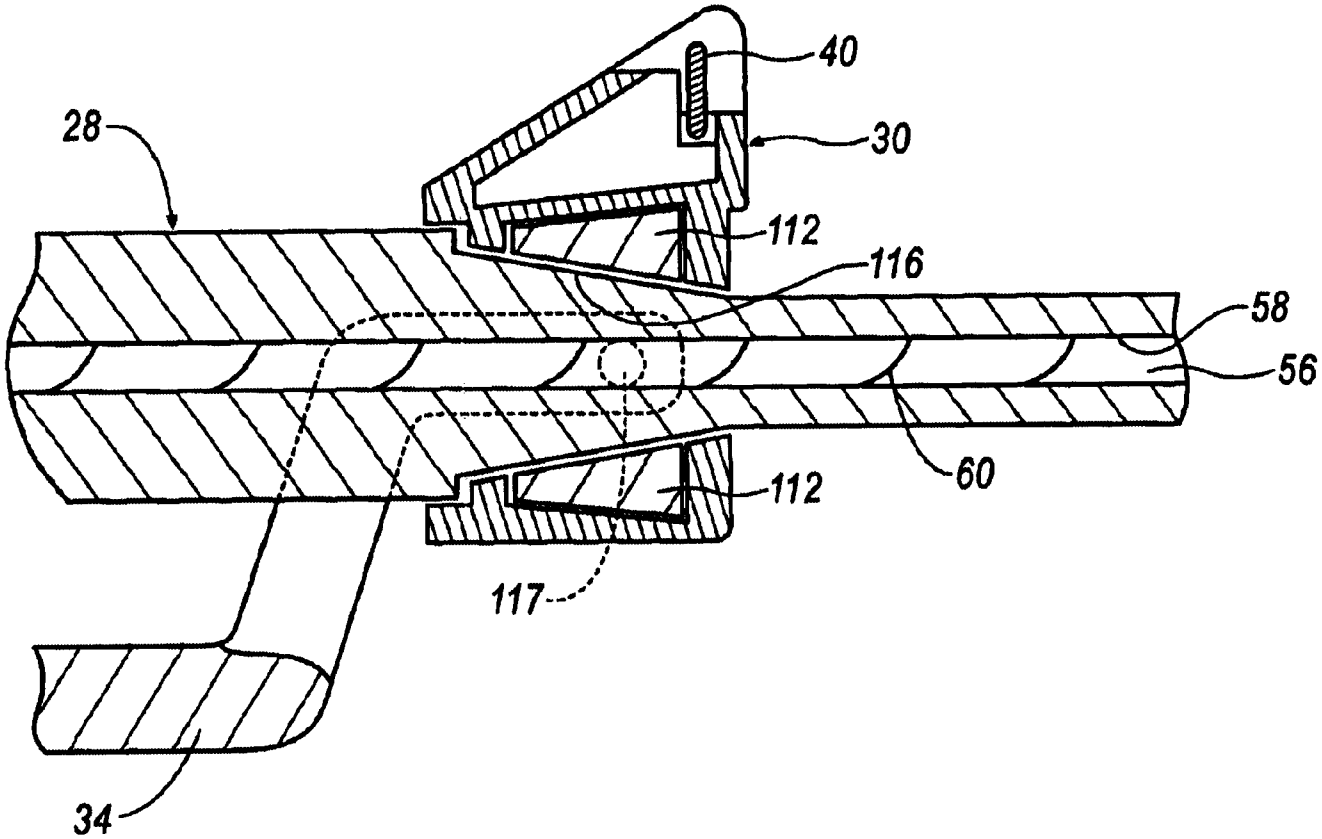
FIG. 7 is a cross-sectional view of the barrel and a supporting barrel mount.

Referring to FIGS. 5 and 7, barrel 28 is provided with an inner bore 56 that extends from receiver 24 to muzzle 46. An inner wall 58 of bore 56 is riffled, i.e., provided with a plurality of spiral grooves 60 that impart gyroscopic stabilization on projectile 27 as it travels through bore 56. The diameter of inner bore 56 is sized to accommodate the particular caliber of projectile 27 fired from weapon 20. The present invention is not, however, intended to be limited to a single caliber projectile 27, such as the caliber depicted in FIG. 5, and that larger or smaller caliber projectiles 27 may be used with the features of the present invention.

Figure 2:
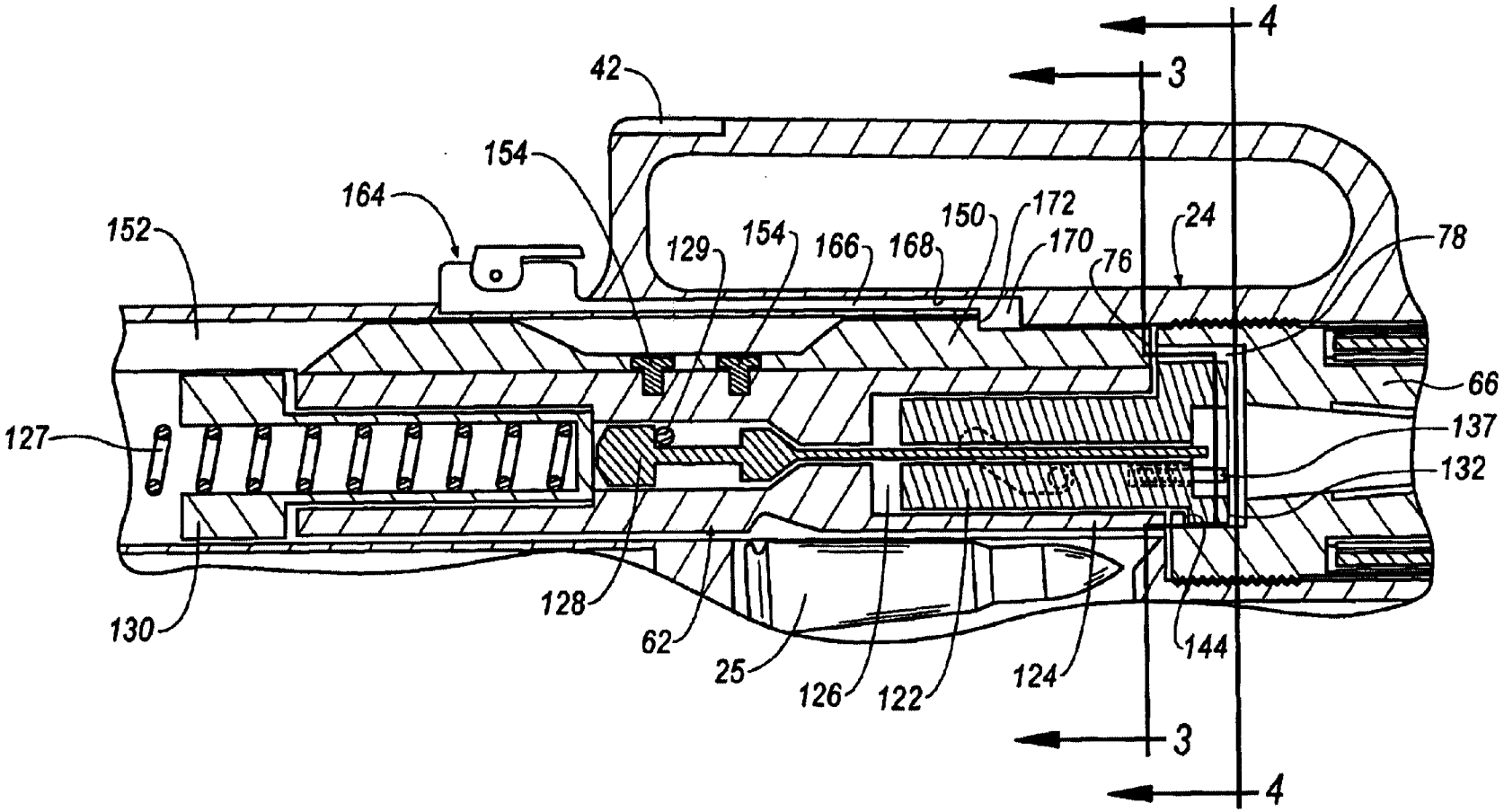
FIG. 2 is a cross-sectional view of a receiver of the weapon of FIG. 1.

Referring to FIG. 2, a cross-sectional view of receiver 24 is shown in detail. Receiver 24 is the body of weapon 20 within which a loading mechanism 62 operates to load cartridge 25 for firing and extracts the spent cartridge casing after projectile 27 is fired. Receiver 24 preferably includes a handle 64 by which a user may carry weapon 20 into combat. The receiver configuration depicted in the accompanying figures is not intended to limit the scope of the present invention, and it is recognized that other receiver designs may advantageously employ the features of the present invention. For example, the shape of handle 64 may be modified when receiver 24 is configured to receive ammunition via a belt-feed system.

Referring to FIG. 5, a cartridge housing 66 is internally secured within a port end 68 of receiver 24. Cartridge housing 66 is a generally cylindrical member having a first exterior surface 70 and a second exterior surface 72. First exterior surface 70 is preferably threaded and engages an internally threaded surface 71 of receiver 24 to secure cartridge housing 66 within receiver 24. Cartridge housing 66 extends from a forward end 74 adjacent barrel 28 to a rearward end 76 (FIG. 2), adjacent loading mechanism 62. Rearward end 76 of cartridge housing 66 includes a port 78 that is sized to receive a portion of loading mechanism 62. As will be described in further detail below, cartridge housing 66 is configured to engage and retain a portion of loading mechanism 62 during the loading and firing of projectile 27.

Figure 6:
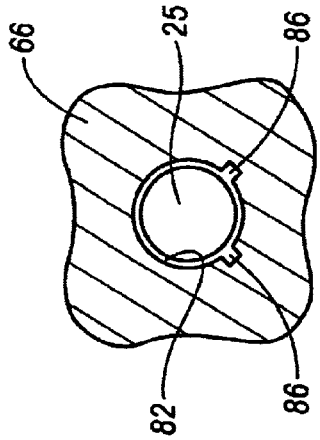
FIG. 6 is a cross-sectional view of the cartridge housing taken along lines 6—6 in FIG. 5.

A tapered chamber 80 extends from port 78 through cartridge housing 66 to a duct 82. Duct 82 extends through the remainder of cartridge housing 66 and is provided in communication with bore 56 of barrel 28. When cartridge 25 is received into chamber 80, cartridge 25 abuts a forward surface 84 of chamber 80 and projectile 27 extends into duct 82. As illustrated in FIG. 6, duct 82 and at least a portion of chamber 80, are provided with at least one axial groove 86 that extends radially outward into cartridge housing 66. Groove 86 is connected to a gas-blowback passage 88 that extends from chamber 80, through cartridge housing 66, to rearward end 76. Each gas-blowback passage 88 terminates into a tube 90 (FIG. 9) that extends rearwardly from cartridge housing 66. Tube 90 is secured to cartridge housing 66, such as by a threaded connection, and is sized to be slidingly received into a portion of loading mechanism 62, as will be described below.

Barrel 28 is rotatively received between receiver 24 and cartridge housing 66. Unlike prior art weapons that employ two or more barrels that rotate about a common axis, barrel 28 rotates about its own axis A—A, thereby reducing the overall weight of weapon 20. To facilitate rotation, a first bearing member 92 is disposed between barrel 28 and receiver 24. Similarly, a second bearing member 94 is preferably disposed between cartridge housing 66 and barrel 28. Bearing members 92 and 94 may comprise any suitable friction reducing bearing, such as a needle bearing, and are not necessarily limited to the bearing configuration depicted in FIGS. 2 and 5. A groove 91 is preferably disposed in forward end 74 of cartridge housing 66. A sealing member 93, such as an O-ring, is received in groove 91 and engages barrel 28 to prevent explosive gases, generated by the ignited propellant charge in cartridge 25, from escaping into the area surrounding bearings 92, 94.

To secure barrel 28 axially within receiver 24, a cap 96 is provided over a flared end 98 of barrel 28 and is affixed to an outer surface 100 of receiver 24. Cap 96 preferably includes a bearing member 102, such as a thrust bearing, which abuts a shoulder 104 on flared end 98 of barrel 28 to substantially reduce friction therebetween. An internally threaded surface 106 of cap 96 engages threads 108 on outer surface 100 to secure cap 96 and barrel 28 to receiver 24. Cap 96 may be provided with one or more external flats 110 for engagement by a wrench or, alternatively, may include a knurled surface for simple hand tightening of cap 96 onto receiver 24. When silent operation of weapon 20 is required, such as during single shot fire control of weapon 20, cap 96 may optionally include a means of inhibiting rotation of barrel 28. For example, a locking mechanism 109, such as lever operated, spring actuated, cam-lock mechanism or other suitable locking mechanism known in the art, may be provided in cap 96 to selectively engaged a notch 111 in barrel 28 to inhibit rotation thereof. During operation of weapon 20, rotation of barrel 28 is preferably in a direction opposite the direction to remove cap 96 from receiver 24.

Referring to FIG. 7, at lease one bearing member 112, such as a tapered roller bearing, is disposed between barrel 28 and barrel mount 30. The end of support arm 34 that attaches to barrel mount 30 is preferably forked to facilitate attachment to barrel mount 30. During assembly of weapon 20, barrel mount 30 is first assembled onto barrel 28 until bearing member 112 abuts a tapered shoulder 116 of barrel 28. The forked end of support arm 34 is then secured to barrel mount 30 by a pair of fasteners 117, such as a bolt or the like, near the midpoint of barrel mount 30. Support arm 34 is then attached to receiver 24 to support barrel 28 between receiver 24 and barrel mount 30. Attaching support arm 34 near the midpoint of barrel mount 30 limits the moment force applied to barrel 28 as support arm 34 is secured to receiver 24.

Referring again to FIG. 2, loading mechanism 62 includes a bolt 122 and a bolt carrier 124. Bolt 122 is generally cylindrical and is slidably received within an inner cavity 126 of a bolt carrier 124. Also slidably received within bolt carrier 124 is a firing pin 128 and a hammer 130. Firing pin 128 extends through bolt 122 and protrudes from bolt 122 when firing pin 128 is moved fully forward within bolt carrier 124. Hammer 130 is biased into contact with bolt carrier 124 and firing pin 128 by a main spring 127. A travel-limiting member 129, such as a cotter pin, is disposed through bolt carrier 124 to limit forward axial travel of firing pin 128 within bolt carrier 124.

Figure 3:
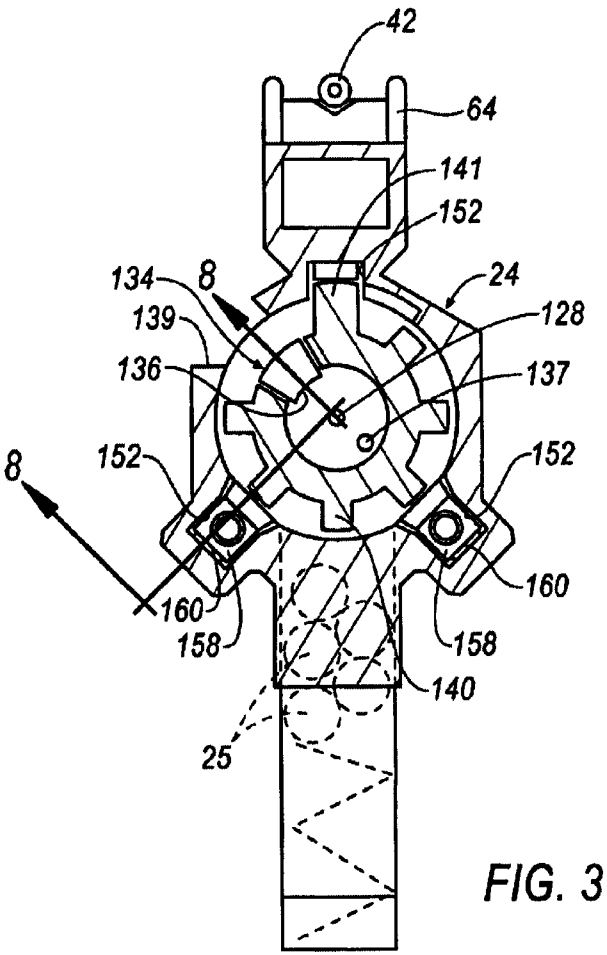
FIG. 3 is a cross-sectional view of the weapon taken along lines 3—3 in FIG. 2, showing the bolt and a bolt carrier disposed within the receiver.

As illustrated in FIGS. 2 and 3, bolt 122 includes a recessed extraction end 132 to which is pivotably connected an extractor 134 for removing a spent casing from barrel 28 once projectile 27 is fired. There are a number of known extractor systems in modern weapons that will function in weapon 20, but the basic form, as illustrated here, is a small, spring-loaded lip 136 that grips onto a narrow rim 138 (FIG. 5) at the base of cartridge 25. As bolt 122 moves forward and engages cartridge 25, extractor pivots radially outward as it engages cartridge 25 and then springs back to grip rim 138 upon further forward movement of bolt 122. In contrast, as bolt 122 recoils, extractor 134 slides with it, pulling the empty casing backward to be ejected.

A spring-loaded ejecting pin 137 is provided to remove the spent casing from receiver 24 when bolt 122 recoils. As bolt 122 is moved into engagement with cartridge 25 during firing of projectile 27, ejecting pin 137 is compressed by cartridge 25 into bolt 122. In contrast, as bolt 122 recoils after firing of projectile 27, the spring force pushes ejecting pin 137 out of bolt 122 and drives the spent casing out of an ejection port 139 in the side of receiver 24. As illustrated in FIG. 1, a deflector 135 may be provided at a rearward end of ejecting port 148 to deflect the ejected casing away from the operator of weapon 20 during use.

Figure 4B:
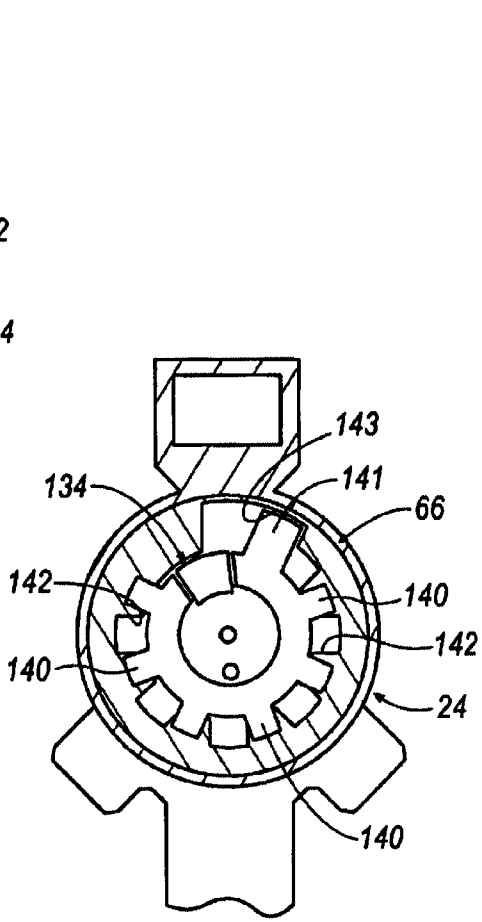
FIG. 4B is a cross-sectional view similar to FIG. 4A showing the bolt engaged with the cartridge housing.
Figure 4A:
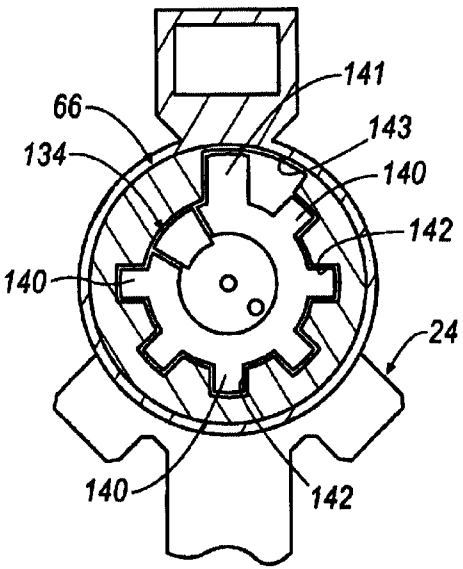
FIG. 4A is a cross-sectional view of a cartridge housing taken along lines 4—4 in FIG. 2, showing the bolt entering the cartridge housing.

Referring to FIGS. 4A and 4B, extraction end 132 of bolt 122 is also provided with a plurality of outwardly extending fins 140, with an uppermost fin 141 being slightly larger than the adjacent fins 140. Each fin 140 is sized to be inserted into a plurality of corresponding grooves 142 that extend inwardly from rearward end 76 of cartridge housing 66 to a shoulder 144 (FIG. 2) in port 78. Once inserted into port 78, bolt 122 can be rotated, as illustrated in FIG. 4B, until fins 140 are interlocked with cartridge housing 66 behind shoulder 144. Uppermost fin 141 is free to rotate within an enlarged groove 143 in cartridge housing 66 and does not interlock with cartridge housing 66.

Referring again to FIG. 2, bolt carrier 124 includes a first or upper wing 150 that extends outwardly from bolt carrier 124 through a channel 152 in receiver 24. Upper wing 150 may be integral with bolt carrier 124 or, as illustrated in FIG. 2, may be attached to bolt carrier 124 by at least one fastener 154, such as a screw or the like.

Figure 8:
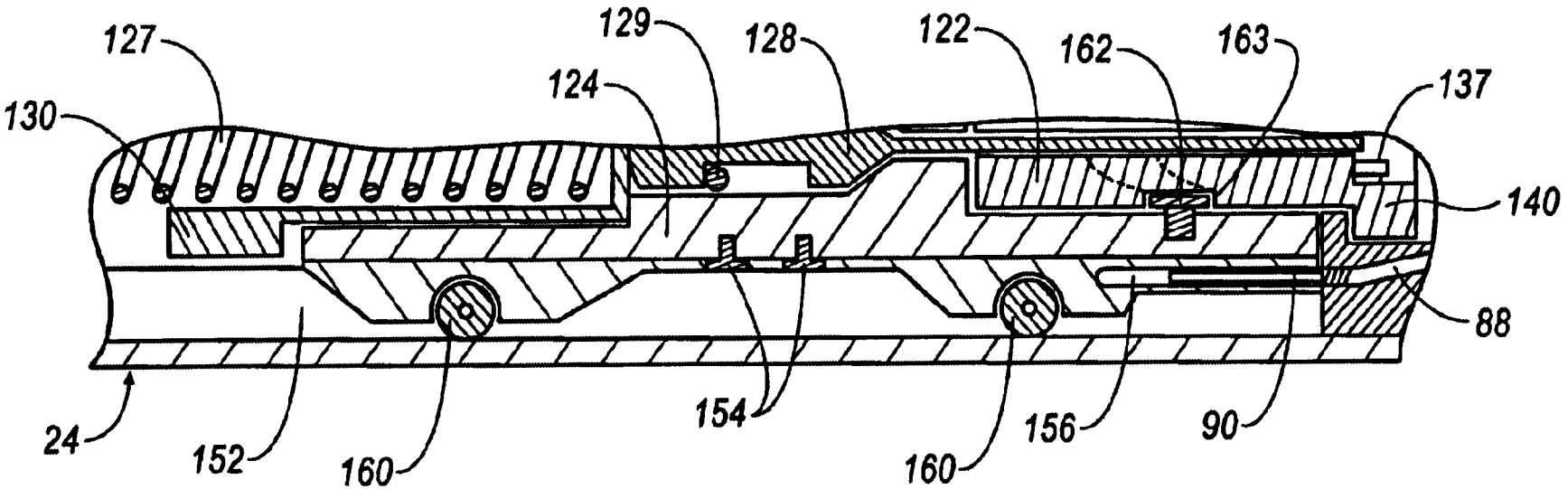
FIG. 8 is a cross-sectional view of a lower wing of the bolt carrier taken along lines 8—8 in FIG. 3.

Referring to FIGS. 3 and 8, bolt carrier 124 preferably includes a pair of lower wings 158 that extend outwardly from bolt carrier 124 through channels 152 in receiver 24. Lower wings 158 are preferably provided with a pair of rollers 160 that are secured for movement with lower wings 158. Rollers 160 reduce friction between lower wings 158 and receiver 24, allowing bolt carrier 124 to easily slide within receiver 24 after firing of projectile 27. Unlike upper wing 150, each lower wing 158 is provided with a longitudinally extending passage 156 sized to receive a tube 90 that extends from cartridge housing 66, as described above.

Referring specifically to FIG. 8, at least one cam bearing 162, which is preferably disposed radially inwardly of at least one of lower wings 158, is attached to an inner wall of cavity 126 between bolt carrier 124 and bolt 122. Cam bearing 162 rides in a recess 163 in an outer surface of bolt 122. Alternatively, cam bearing 162 may be attached to an outer surface of bolt 122 for travel within a recess 163 in the inner wall of cavity 126. As will be described in further detail below, axial movement of bolt carrier 124 while bolt 122 is held axially stationary within cartridge housing 66 causes cam bearing 162 to impart rotation on bolt 122, as cam bearing 162 travels within recess 163.

Referring again to FIG. 2, weapon 20 also includes a manual ejecting member 164 that extends through receiver 24 outward of upper wing 150. Ejecting member 164 includes an elongated body 166 that is slidably disposed in a slot 168 in receiver 24. Body 166 includes, on one end, a flange 170 for engaging a shoulder 172 on upper wing 150 and, on the other end, a locking device 174, such as a lever-actuated cam, to prevent movement of ejecting member 164 during operation of weapon 20. If a cartridge 25 in chamber 80 does not fire or weapon 20 is out of ammunition, ejecting handle 164 can be used to manually pull bolt carrier 124 backward against the force of spring 127, to eject the defective cartridge 25 or to "cock" weapon 20 in its open-bolt position.

Figure 9:
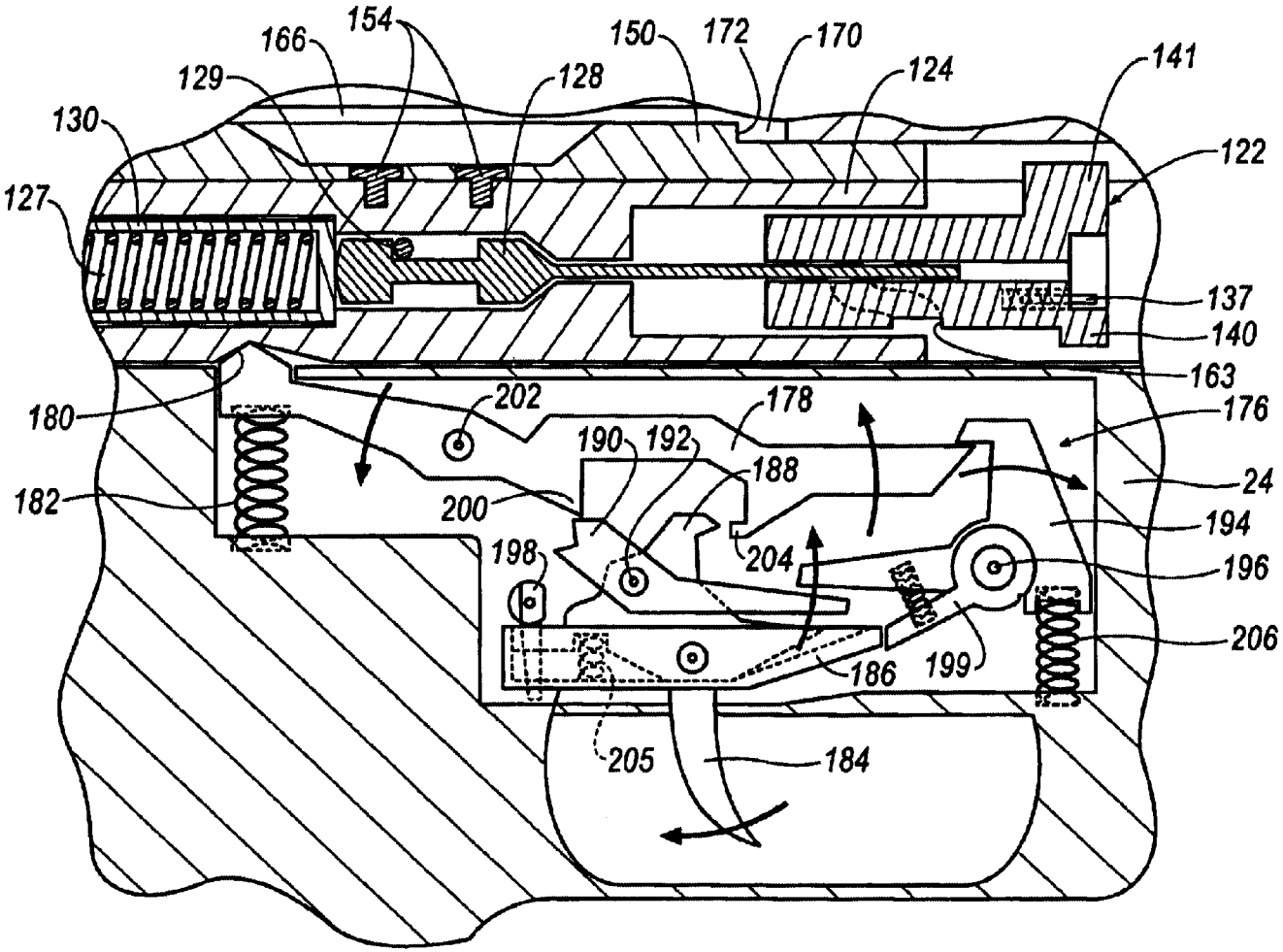
FIG. 9 is a cross-sectional view of a firing mechanism prior to firing the weapon of FIG. 1.

Referring to FIG. 9, a firing mechanism 176 is provided in weapon 20 below bolt carrier 124 to release loading mechanism 62 for firing projectile 27. In a preferred embodiment, firing mechanism 176 includes a sear 178 that is biased into abutment with a bent 180 in bolt carrier 124 by a resiliently compressible member 182, such as a compression spring, prior to firing projectile 27. A trigger 184, which is pivotably attached to receiver 24, includes a grooved member 186 within which a first locking member 188 resides. An arm member 190 is pivotably attached to first locking member 188 for rotation about an axis 192. A second locking member 194, which is fixed to pivot about an axis 196, includes a spring biased lower arm 199 that is also pivotable about the same axis 196. Lower arm 199 prevents the inadvertent release of second locking member 194 from sear 178 without trigger 184 first being pulled.

Weapon 20 is preferably a selective fire weapon, meaning weapon 20 can, at the user's discretion, fire a single round or automatically fire multiple rounds in succession. A selector cam 198 extends through receiver 24 above grooved member 186 and first locking member 188. As is known in the art, selector cam 198 can be manually rotated to limit the rotation of trigger 184, such that only one round, multiple rounds or no rounds may be fired.

Figure 10:
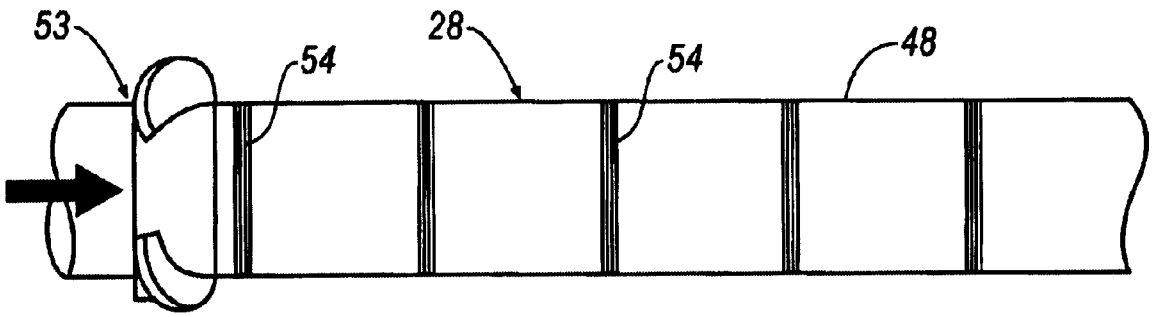
FIG. 10 is a partial plan view of a ring member and the barrel according to another embodiment of the present invention.
Figure 11:
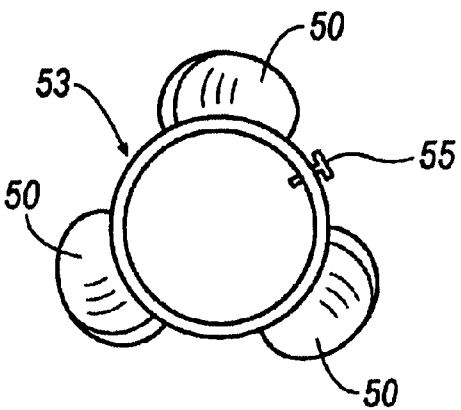
FIG. 11 is a front view of the ring member shown in FIG. 10.

As illustrated by the directional arrows in FIG. 10, pulling trigger 184 results in arm member 190 engaging a pointed protrusion 200 on sear 178. Engagement of sear 178 also causes arm member 190 to rotate about axis 192 and engage second locking member 194, forcing second locking member 190 to disengage from sear 178. Sear 178 is then free to rotate about an axis 202, due to the force of spring 127 forcing bolt carrier 124 forward and bent 180 forcing sear 178 downward.

When selector cam 198 is actuated to the "single fire" position, trigger 184, grooved member 186 and first locking member 188 are free to rotate to a position that allows a catch 204 on sear 178 to engage first locking member 188 as bolt carrier 124 recoils. To facilitate engagement with catch 204, a spring 205 (shown hidden in FIG. 10) is disposed between first locking member 188 and grooved member 186, which allows first locking member 188 to slightly pivot as catch 204 engages it during its downward stroke. Alternatively, when selector cam 198 is actuated to the "automatic fire" position, grooved member 186 and first locking member 188 are not free to rotate to a position that allows catch 204 to engage first locking member 188. This permits sear 178 to pivot freely about axis 202 as bolt carrier 124 repeatedly recoils and then moves forward to fire projectile 27. Releasing trigger 184 allows second locking member 194 to pivot back, due to the biasing force of a spring 206, to a position that engages sear 178 when sear 178 is received in bent 180. Trigger 184 also pivots back to the pre-fire position shown in FIG. 9 under the influence of a return spring (not illustrated), as is known in the art.

Further understanding of the present invention will become apparent from a review of the operation of weapon 20, which is described in detail herein. To prepare weapon 20 to fire, bolt carrier 124 is pulled backward using ejecting member 164, causing bolt 122 to slide with bolt carrier 124 against the biasing force of spring 127. When bolt carrier 124 and bolt 122 are slid backwards, sear 178 engages bolt carrier 124 and prevents it from sliding forward under the force of spring 127. As bolt carrier 124 and bolt 122 are recoiled, ammunition feed system 26 pushes a new cartridge 25 into the breach formed between bolt 122 and cartridge housing 66. When trigger 184 is pulled, sear 178 releases bolt carrier 124 and spring 127 drives bolt carrier 124 and bolt 122 forward pushing cartridge 25 into chamber 80. As bolt 122 hits the back of cartridge 25, firing pin 128 is engaged by hammer 130 and strikes a primer (not illustrated) on cartridge 25, which ignites the stored propellant. The explosive gas from the ignited propellant drives projectile 27 down barrel 28 imparting a spin on projectile 27 and an oppositely directed rotational force on barrel 28.

The gas pressure from the ignited propellant is directed through grooves 86 into tubes 90, forcing bolt carrier 124 backwards in receiver 24 as bolt 122 remains interlocked with cartridge housing 66. As bolt carrier 124 slides backward, bolt 122 rotates due to the cam action of cam bearing 162 riding in recess 163. Rotation of bolt 122 disengages it from cartridge housing 66, leaving bolt 122 free to slide backward, due to the gas pressure, with bolt carrier 124. Uppermost fin 141 slides in channel 152 preventing bolt 122 from rotating as it recoils back into receiver 24. Extractor 134 pulls the spent casing out of chamber 80 and ejecting pin 137 forces the spent casing out of weapon 20 once the casing is fully removed from cartridge hosing 66. When bolt 122 is in the fully recoiled position, a new cartridge 25 is automatically fed into the breech just before spring 127 pushes bolt carrier 124 and bolt 122 forward, starting the process all over again. When weapon 20 is placed in "automatic fire" mode, this process continues as long as trigger 184 remains pulled and there is ammunition in feed system 26. Also, because weapon 20 uses an open-bolt type loading mechanism 62, the loading mechanism will assist in cooling weapon 20. Loading mechanism 62 helps move air within receiver 24 and through barrel 28 as cartridges 25 are loaded into cartridge housing 66 during firing of projectile 27.

As projectile 27 is propelled through bore 56, groove 60 imparts a spin on projectile 27. Simultaneously, an oppositely directed rotational force is imparted on barrel 28 due to the moving projectile 27, causing barrel 28 to spin in a direction opposite the rotation of projectile 27. However, due to inertia and friction between the mating parts, barrel 28 does not fully counteract the gyroscopic stabilization provided to projectile 27.

As barrel 28 spins, blades 50 capture air and generate airflow across surface 52 to cool barrel 28. Moreover, the airflow generated by blades 50 is drawn from across receiver 24 to cool receiver 24 during operation. As will be appreciated, the speed with which barrel 28 rotates is a function of, inter alia, the speed with which projectiles 27 are fired from weapon 20 and the number projectiles 27 fired in succession. When only a small number of projectiles 27 are fired in succession, barrel 28 will rotate rather slowly. However, when a relatively large number of projectiles 27 are fired in succession, inertia of barrel 28 is overcome allowing it to rotate at a relatively higher speed. It will be appreciated that when only a small number of projectiles 27 are fired in succession, barrel 28 does not necessarily need to rotate as fast because barrel 28 is not as hot. However, when a relatively large number of projectiles 27 are fired, barrel 28 achieves a relatively higher temperature, which is dissipated by movement of air across weapon 20.

Alternatively, it is recognized that other means may be employed in weapon 20 to impart rotation on barrel 28 or to supplement the rotational force generated by projectiles 27 traveling through barrel 28. For example, an electric motor could be provided in receiver 24 having a gear set for distributing rotational power from the motor to barrel 24. An alternative or supplemental source of rotation could be configured to rotate barrel 28 at a significantly higher speed, thereby generating a larger volume of airflow across barrel 28.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A weapon for firing a projectile comprising:

a receiver;

a loading mechanism positioned in the receiver for loading and unloading the weapon;

at least one feed system that supplies the loading mechanism with ammunition;

a firing mechanism; and a barrel rotatively secured to the receiver and rotatively supported a predetermined distance removed from the receiver, the barrel including a rifled bore that imparts a gyroscopic spin on the projectile and a rotational force on the barrel causing the barrel to spin as the projectile is fired, wherein the barrel is free to spin continuously in a predetermined direction.

2. The weapon of claim 1, wherein the barrel includes a plurality of blades for generating airflow across the barrel and the weapon as the barrel rotates.

3. The weapon of claim 2, wherein each blade is provided with a slight twist to capture air.

4. The weapon of claim 2, wherein the blades are arranged substantially uniformly about the circumference of the barrel.

5. The weapon of claim 2, wherein the blades cooperate to form at least one fan structure.

6. The weapon of claim 5, wherein the barrel includes a plurality of fan structures extending axially along at least a portion of the barrel.

7. The weapon of claim 1, wherein at least one roller bearing is disposed between the barrel and the receiver.

8. The weapon of claim 1, further including a cap that removably secures the barrel to the receiver. barrel.

9. The weapon of claim 1 further including a barrel mount for rotatively supporting the barrel at a predetermined distance removed from the receiver.

10. The weapon of claim 9, wherein the barrel mount is supported by at least one support bar.

11. A weapon for firing a projectile comprising:

a receiver;

a loading mechanism positioned in the receiver for loading and unloading the weapon, at least one feed system that supplies the loading mechanism with ammunition;

a firing mechanism; and a barrel rotatively secured to the receiver, the barrel including a plurality of blades for generating airflow across the barrel and the weapon as the barrel rotates.

12. The weapon of claim 11, wherein the barrel mount is supported by at least one support bar.

13. The weapon of claim 11, wherein each blade is provided with a slight twist to capture air.

14. The weapon of claim 13, wherein the blades are arranged substantially uniformly about the circumference of the barrel.

15. The weapon of claim 11, wherein the blades cooperate to form at least one fan structure.

16. The weapon of claim 15, wherein the barrel includes a plurality of fan structures extending axially along at least a portion of the barrel.

17. A weapon for firing a projectile comprising:

a receiver;

a loading mechanism positioned in the receiver for loading and unloading the weapon;

at least one feed system that supplies the loading mechanism with ammunition;

a firing mechanism; and a barrel rotatively secured to the receiver, the barrel including a rifled bore that imparts a gyroscopic spin on the projectile and a rotational force on the barrel causing the barrel to spin as the projectile is fired, wherein a first end of the barrel is rotatively supported by a cartridge housing.

18. The weapon of claim 17, wherein at least one bearing is disposed between the barrel and the cartridge housing.

19. The weapon of claim 17, wherein the cartridge housing includes at least one gas blowback passage that directs gas pressure from the fired ammunition into the loading mechanism.

20. A weapon for firing a projectile comprising:

a receiver;

a loading mechanism positioned in the receiver for loading and unloading the weapon;

at least one feed system that supplies the loading mechanism with ammunition;

a firing mechanism; and a barrel rotatively and removably secured to the receiver by a cap, the barrel including a rifled bore that imparts a gyroscopic spin on the projectile and a rotational force on the barrel causing the barrel to spin as the projectile is fired, wherein at least one bearing is disposed between the barrel and the cap.

21. A weapon for firing a projectile comprising:

a receiver;

a loading mechanism positioned in the receiver for loading and unloading the weapon;

at least one feed system that supplies the loading mechanism with ammunition;

a firing mechanism; and a barrel rotatively secured to the receiver and rotatively supported a predetermined distance removed from the receiver, the barrel including a rifled bore that imparts a gyroscopic spin on the projectile and a rotational force on the barrel causing the barrel to spin as the projectile is fired, wherein the barrel includes a plurality of blades for generating airflow across the barrel and the weapon as the barrel rotates.

22. The weapon of claim 21, wherein each blade is provided with a slight twist to capture air.

23. The weapon of claim 21, wherein the blades are arranged substantially uniformly about the circumference of the barrel.

24. A weapon for firing a projectile comprising:

a receiver;

a loading mechanism positioned in the receiver for loading and unloading the weapon;

at least one feed system that supplies the loading mechanism with ammunition;

a firing mechanism; and a barrel rotatively secured to the receiver and rotatively supported a predetermined distance removed from the receiver, the barrel including a rifled bore that imparts a gyroscopic spin on the projectile and a rotational force on the barrel causing the barrel to spin as the projectile is fired, wherein at least one roller bearing is disposed between the barrel and the receiver.

* * * * *

UNITED STATES PATENT AND TRADEMARK OFFICE

CERTIFICATE OF CORRECTION

PATENT NO. : 6,679,156 B1
DATED : January 20, 2004
INVENTOR(S) : Samir A. Danou

It is certified that error appears in the above-identified patent and that said Letters Patent is hereby corrected as shown below:

Column 10,
Line 25, after the word "receiver", delete barrel.
Lines 42-43, delete "mount is supported by at least one support bar." and insert -- includes a rifled bore that imparts a gyroscopic spin on the projectile and a rotational force on the barrel causing the barrel to spin as the projectile is fired. --

Column 10,
Line 46, delete "13" and insert -- 11 --.

Signed and Sealed this

Twenty-fifth Day of May, 2004

JON W. DUDAS
*Acting Director of the United States Patent and Trademark Office*